US005806546A

United States Patent [19]

Ni

[11] Patent Number: 5,806,546

[45] Date of Patent: Sep. 15, 1998

[54] METHOD OF ELIMINATING CORRUGATION IN CENTRAL UMBRELLA COVER

[76] Inventor: Fong-Ming Ni, P.O. Box 96-405, Taipei, Taiwan, 10098

[21] Appl. No.: 659,863

[22] Filed: Jun. 7, 1996

[51] Int. Cl.[6] ..... A45B 25/18

[52] U.S. Cl. ..... 135/33.2; 135/15.1

[58] Field of Search ..... 135/33.2, 33.4, 135/33.41, 15.1

[56] References Cited

U.S. PATENT DOCUMENTS

| | | | |
|---|---|---|---|
| 2,039,987 | 5/1936 | Goldman | 135/33.2 |
| 3,042,056 | 7/1962 | Todorovic | 135/33.2 |
| 3,557,809 | 1/1971 | Vazquez | 135/33.2 X |
| 4,794,939 | 1/1989 | Okuda | 135/33.2 |
| 5,020,559 | 6/1991 | Lai | 135/33.2 |
| 5,218,981 | 6/1993 | Lai | 135/33.2 |
| 5,488,966 | 2/1996 | Baldwin et al. | 135/33.2 |

FOREIGN PATENT DOCUMENTS

| | | | |
|---|---|---|---|
| 2034669 | 5/1992 | Canada | 135/33.2 |
| 0345036 | 12/1936 | Italy | 135/33.41 |
| 0605156 | 5/1960 | Italy | 135/33.41 |

*Primary Examiner*—Lanna Mai

[57] ABSTRACT

A method of eliminating corrugation in central umbrella cover, being made of a plain weave cloth, in which the weft has no stretchability, while the warp has a slight stretchability; before the umbrella cloth being cut into an umbrella cover, the umbrella cover and the main rib are set a different angle of ten degrees; the tail end of the main ribs and the sewing points of the umbrella cloth are not fallen on the parallel line of the warp or the weft; from the sewing points to the central part of the ribs, there are different length so as to balance the tension of various stretch points; the edge of the umbrella cover is cut out and sewed properly so as to provide suitable corrugation-proof. When the umbrella is opened, the central portion of the umbrella cover would not have corrugation and looseness because of the main ribs having a slight curvature, and the oblique weave mesh able to balance the stretched tension.

3 Claims, 8 Drawing Sheets

PRIOR ART

PRIOR ART

PRIOR ART

METHOD OF ELIMINATING CORRUGATION IN CENTRAL UMBRELLA COVER

BACKGROUND OF THE INVENTION

1. Field of the Invention

This invention relates to an umbrella, and particularly to an umbrella made of a single piece of umbrella cloth so as to eliminate the corrugation condition in the central portion of the umbrella cover.

2. Description of the Prior Art

As shown in FIGS. 1 to 3, a conventional umbrella is made of a plain weave cloth to be cut into a plurality of triangular-shaped pieces, of which the warp and the weft are cut in perpendicular to each other; therefore, the weft of the triangular-shaped piece has no stretchability, while the warp has a slight stretchability. All the triangular-shaped pieces are sewed together to form into an umbrella cover. The tail end of each main rib is used for fastening the connection point between two triangular-shaped pieces by means of an end sheath, or sewing method. The umbrella cover on the main rib has a slight stretchability because of oblique weave mesh. When opening the umbrella, the central portion of the umbrella cover would not have any corrugation because of the slight curvature of the main ribs and the oblique weave mesh; however, to sew an umbrella cloth takes more time and manpower, and requires accuracy upon cutting the same; further, the umbrella cover is unable to print with an integrated pattern.

A conventional single umbrella cover as shown in FIGS. 4 and 5, a Taiwanese Patent application No. 7314261, in which a piece of plain weave cloth is cut out into an octagonal shape to be mounted on the main ribs. The umbrella cover over the main ribs is cut into a gap cut 41 in a suitable length, being sewed together with a overlock method. The edge of the umbrella cover is sewed with a overlock method so as to prevent the edge portion from having corrugation and looseness upon the umbrella being opened; such gap cut being sewed together for corrugation-proof is a well-known art. According to the prior art, the gap cut 41 on the parallel lines of the warp and the weft of the umbrella cloth is added with a straight edge part 42, which is only furnished on four main ribs so as to increase the thickness of the edge sewed, and to prevent the umbrella cloth from being damaged by the tension of the central part of the main ribs upon opening the umbrella. The curvature of the umbrella is determined with the size and depth of the gap cut. When opening the umbrella, the central portion of the umbrella will have a slight curvature to cause a tension in the central portion of the umbrella cover and an unbalanced stretchability of the four main ribs in the oblique weave mesh; all the aforesaid factors cause corrugation and looseness in the central portion of the umbrella cover.

FIGS. 6 and 7 illustrate another conventional umbrella with a single cover under Taiwanese Patent application No. 81205935, which has an octagonal umbrella cloth, and each angle of the octagon is furnished with a gap in the warp and weft direction, being sewed together so as to prevent the edge of the umbrella cover from corrugation and looseness. In the aforesaid conventional umbrella, the four main ribs are mounted in a direction being parallel with the warp and the weft, and also in the direction the oblique weave mesh; when the umbrella is opened, a portion of the main rib between the sub-main rib and the upper rib hub will have a slight curvature to cause the central portion of the umbrella cover to have a slight curvature, which causes an unbalanced tension, i.e., a corrugation and looseness to be resulted in the central portion of the umbrella cover.

As shown in FIG. 8, the top of the handle rod 22 of a conventional umbrella 11 is mounted with an upper rib hub 20 for connecting ribs 14; the upper rib hub 20 is used for connecting one end of each main rib 17 in radial direction. The mid-part of each main rib 17 is furnished with a connecting point 27 to connect pivotally with a sub-main rib 21. Other end of the sub-main rib 21 is connected with a lower rib hub 24 on a pushing handle 25. The umbrella cover 16 is a conventional single-piece cloth. The umbrella center 13 of the umbrella is mounted with a sheath cap 26 fixed on the top end of the handle rod 22, being close to the upper rib hub 20. The edge of the umbrella cover 16 is processed with a corrugation-proof method so as to eliminate the looseness of the edge portion; however, the central portion 23 between the connecting point 27 on the main rib 17 and the upper rib hub 20 will have a corrugation and looseness upon opening the umbrella because of a slight curvature taking place between the sub-main rib and the upper rib hub, which is caused by an unbalanced tension.

SUMMARY OF THE INVENTION

This invention provides a method of eliminating corrugation in central umbrella cover, of which the umbrella cover is made of a plain weave cloth; the weft of the plain weave cloth has no any stretchability, while the warp thereof has a slight stretchability. The main rib direction is set at an angle of ten degrees from the direction of the warp or the weft. The sewing points on the tail ends of the main ribs are not fallen on the parallel line of the warp or weft of the cloth. From the sewing points to the central of the main ribs, there are different length for balancing the tension at each stretch point. The edge of the umbrella cover is treated with cutting and sewing for corrugation-proof so as to prevent corrugation and looseness from taking place along the edge portion.

The present invention provides a method of eliminating corrugation in central umbrella cover, in which the sewing points on the tail ends of the main ribs are not fallen on the parallel line of the warp or the weft of the umbrella cloth; instead, the sewing points are fallen on the oblique weave mesh having different stretch tension; when the umbrella is opened, the tension from the sewing point of the tail end of the main rib will extend to the central portion of the umbrella cover so as to balance the curvature from the sub-main rib to the handle rod, and to eliminate the corrugation in the central umbrella cover as a result of unbalanced stretch.

The present invention provides a method of eliminating corrugation in central umbrella cover, in which the main rib and the warp and weft are set at a different angle of ten degrees so as to obtain a given length of the sewing point at the tail end of the main rib, in order to eliminate a corrugation taking place in the central umbrella cover. The edge of the umbrella will be cut and sewed properly to prevent from having any corrugation and looseness; in other words, the tension between the umbrella cover and the sewing points at the tail ends of the main ribs will be balanced upon the umbrella being opened or closed; further, an impact between the main ribs and the umbrella cover will be eliminated.

DETAILED DESCRIPTION OF THE PREFERRED EMBODIMENT

Figure 1:
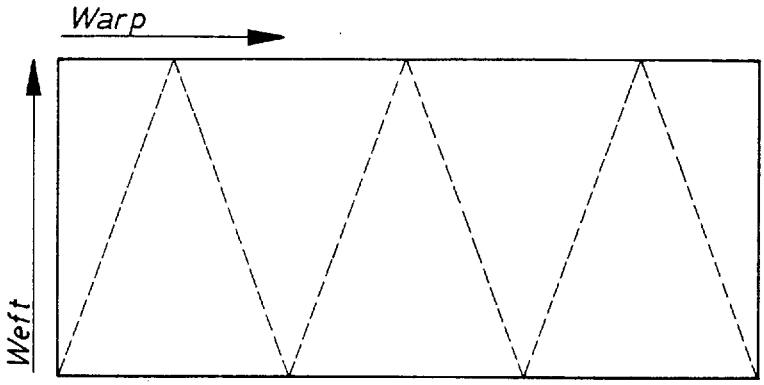
FIG. 1 is a plan view of a conventional umbrella.
Figure 2:
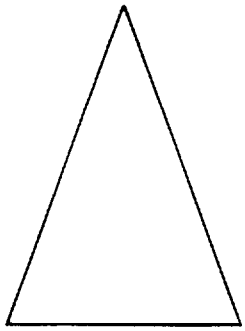
FIG. 2 illustrates a triangle-shaped umbrella cloth for a conventional umbrella.
Figure 3:
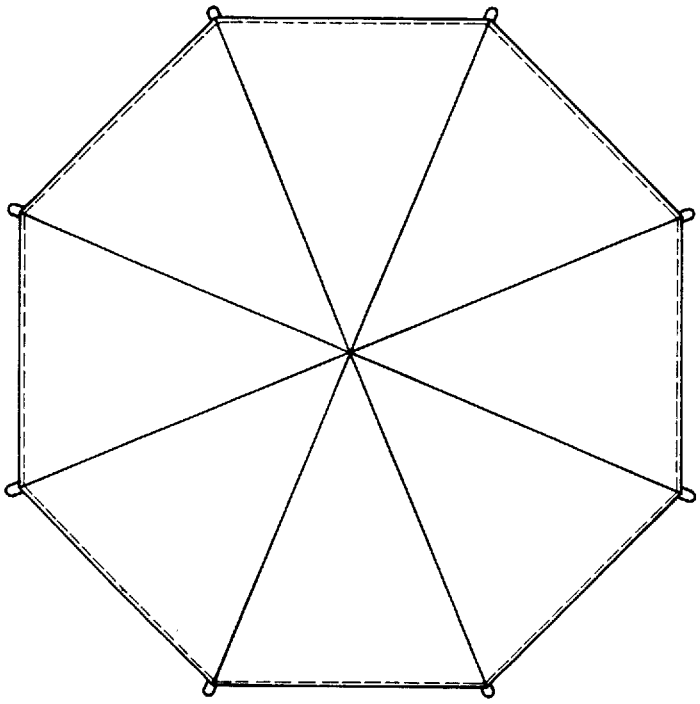
FIG. 3 is a top view of a conventional umbrella cloth.
Figure 4:
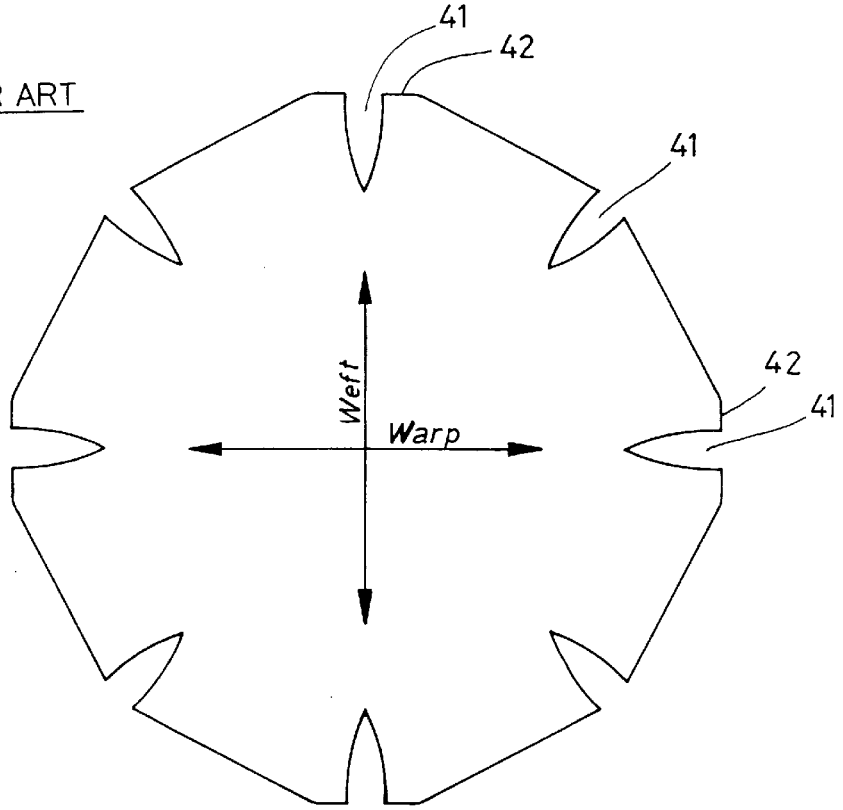
FIG. 4 illustrates a single umbrella cloth cut into an octagonal shape.
Figure 5:
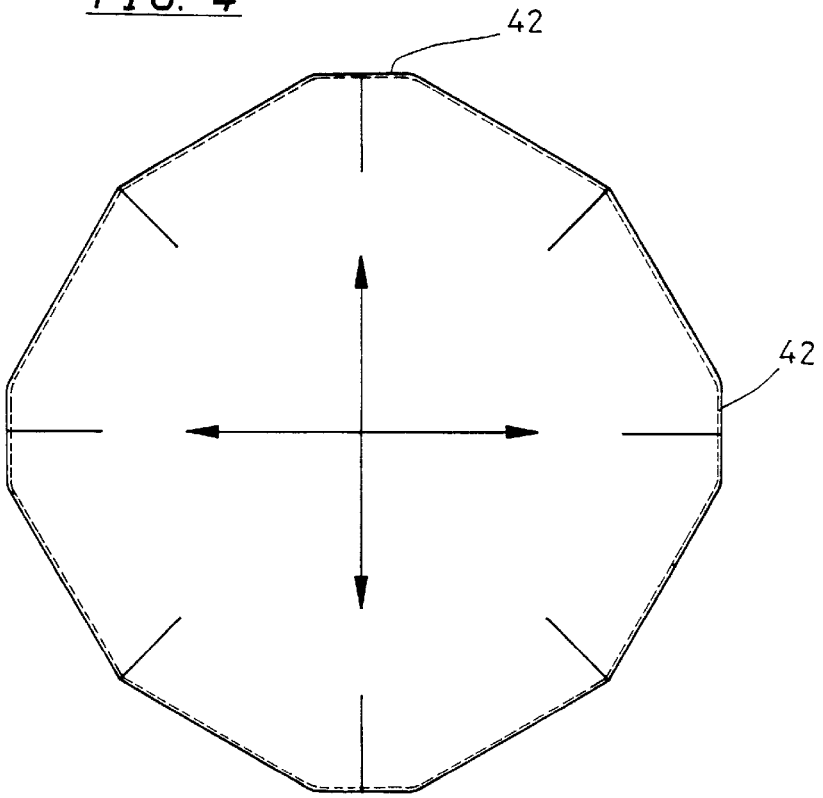
FIG. 5 illustrates the gaps cut in the umbrella cloth as shown in FIG. 4 being sewed up.
Figure 6:
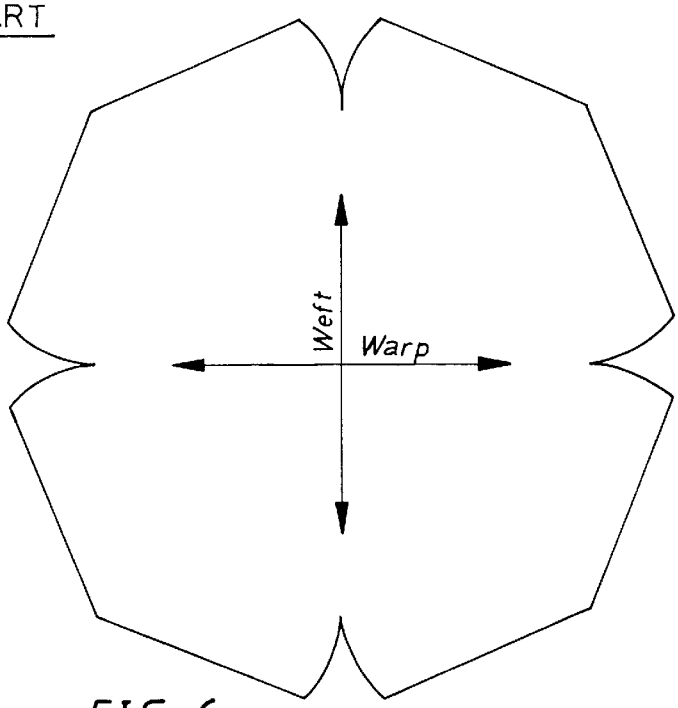
FIG. 6 illustrates the warp and weft of conventional umbrella with the gaps cut of the single umbrella cloth.
Figure 7:
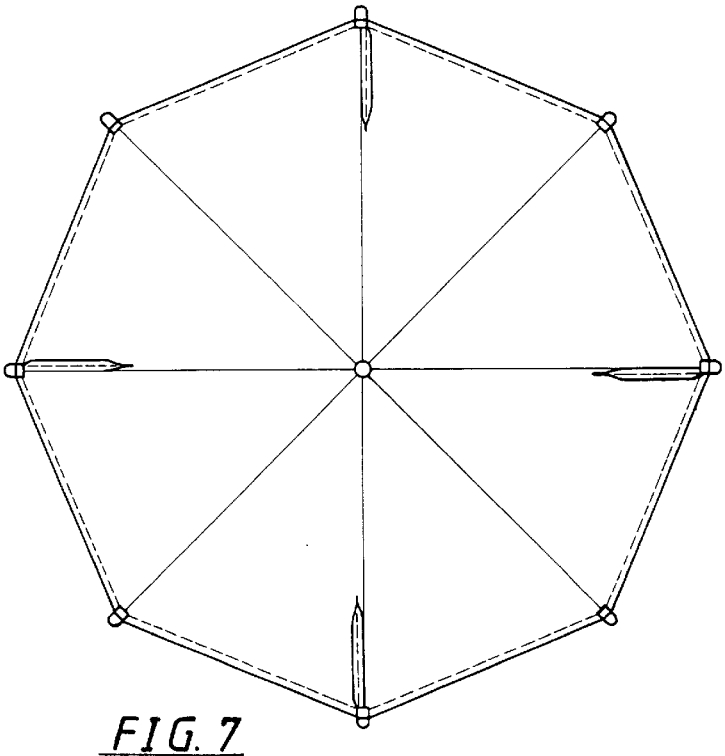
FIG. 7 illustrates the gaps cut as shown in FIG. 6 being sewed up.
Figure 8:
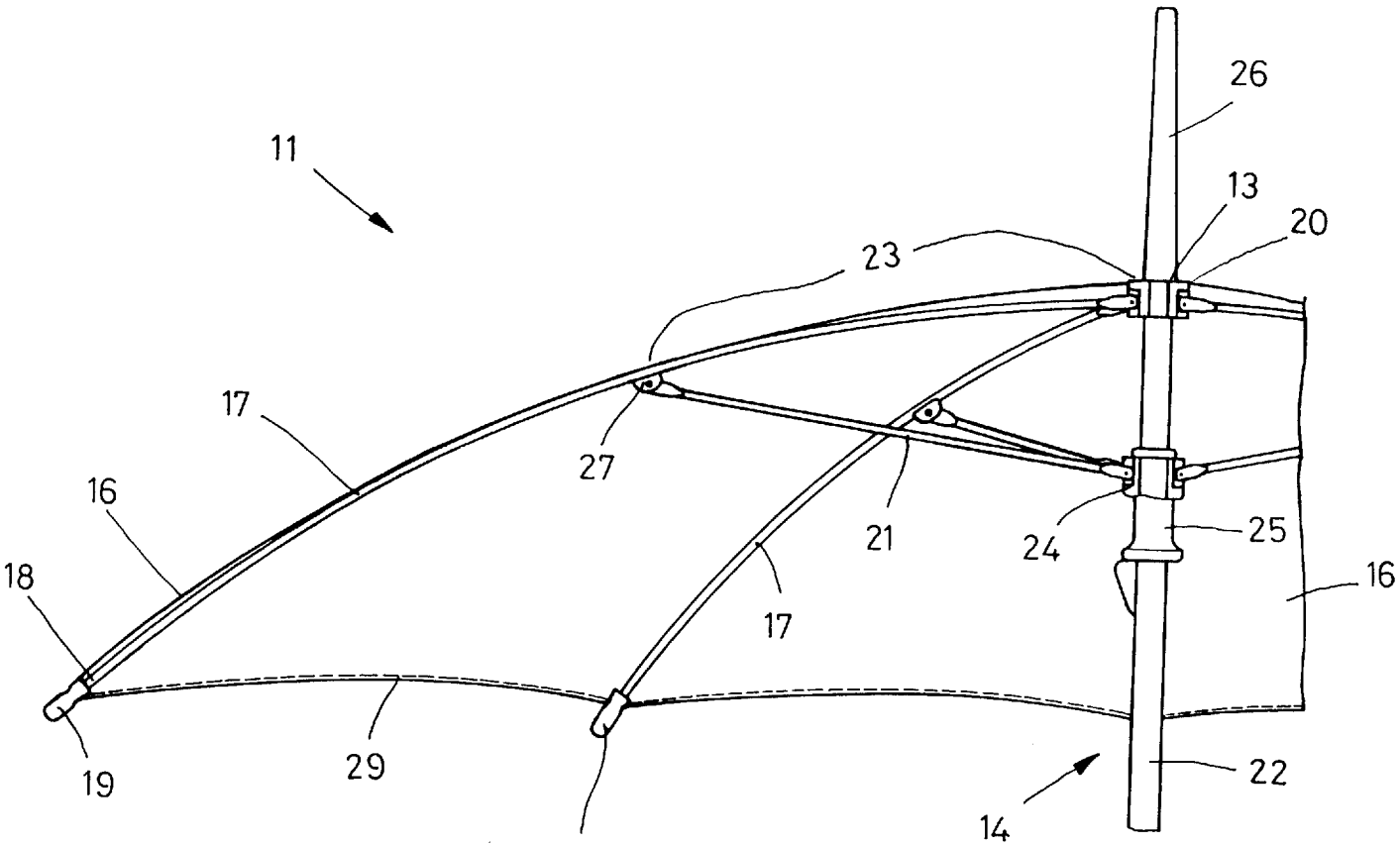
FIG. 8 illustrates the relation between the umbrella surface and the umbrella ribs according to the present invention.

This invention relates to a method of eliminating corrugation in central umbrella cover; as shown in FIG. 8, the umbrella cover 16 is made of a single piece of cloth; before the cover 16 is mounted on the umbrella ribs, the central portion 23 between the pivotal joint 27 and the upper rib hub 20 is processed to eliminate corrugation by means of cutting method and sewing method. Since the umbrella cover 16 is made of a single piece of cloth, the central portion 23 and the edge portion of the cover 16 will not become loose and corrugated upon the umbrella being opened because of the tail ends of the main ribs 18 providing a balanced pulling force.

The umbrella cover of the present invention is made of a plain weave cloth, in which two sets of yarns are woven together perpendicularly; before being cut into a single umbrella cover, the cloth is printed with a color pattern by means of a silk-screen printing machine, and then is processed with water-proof method, which is the same process method as applied to the conventional single-piece umbrella cover.

Figure 9:
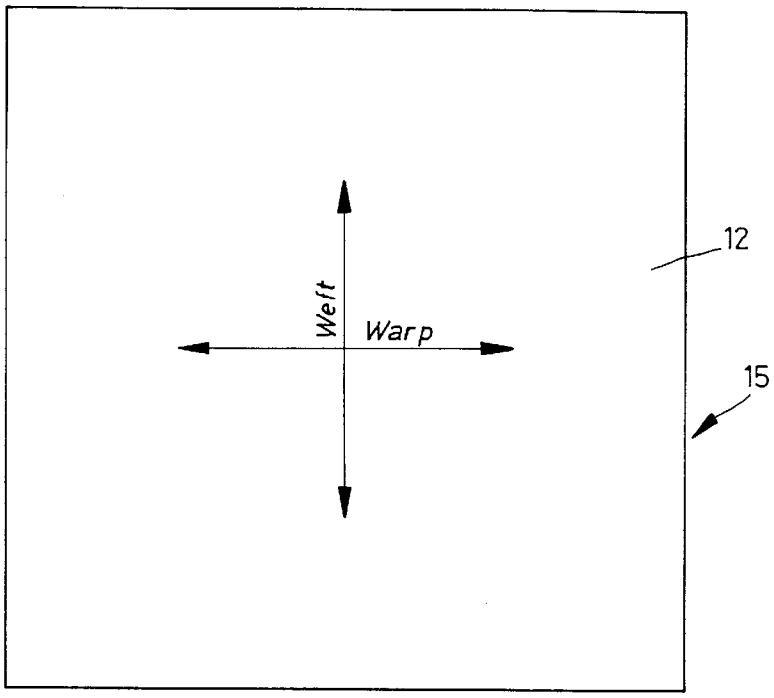
FIG. 9 is a single umbrella cloth according to the present invention, showing the warp and weft arrangement thereof.
Figure 10:
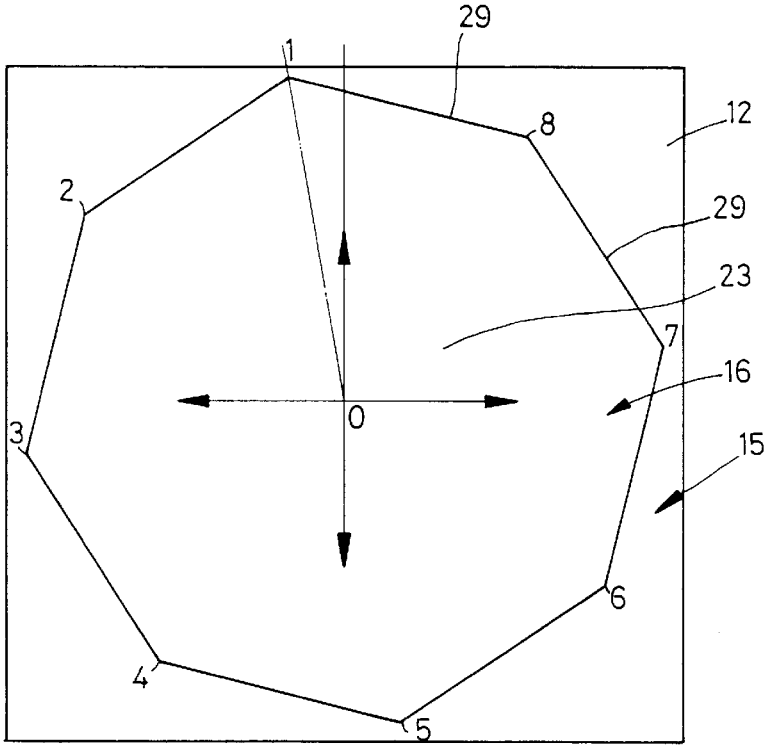
FIG. 10 is a plan view of the present invention, showing the angular difference between the umbrella cover and the warp and the weft thereof.

As shown in FIGS. 8 to 10, the umbrella cloth is printed with integrated patterns; then, the cloth is cut out into single-piece umbrella cover 15 in accordance with the position of the pattern, the directions of the warp and weft, and size of an umbrella cover (as shown in FIG. 9). The weft in the single-piece umbrella cover 15 made of the plain weave cloth 12 has no stretchability, while the warp has a slight stretchability. In order to let the edge portion and the central portion of an umbrella cover 16 have a balance tension, the umbrella cloth 15 is furnished with an octagonal edge. Among the main ribs, one set of the main ribs are arranged into a cross shape as a reference line, which is then turned at a given angle. All the main ribs are set not on the parallel line of the warp or the weft (as shown in FIG. 10).

Figure 11:
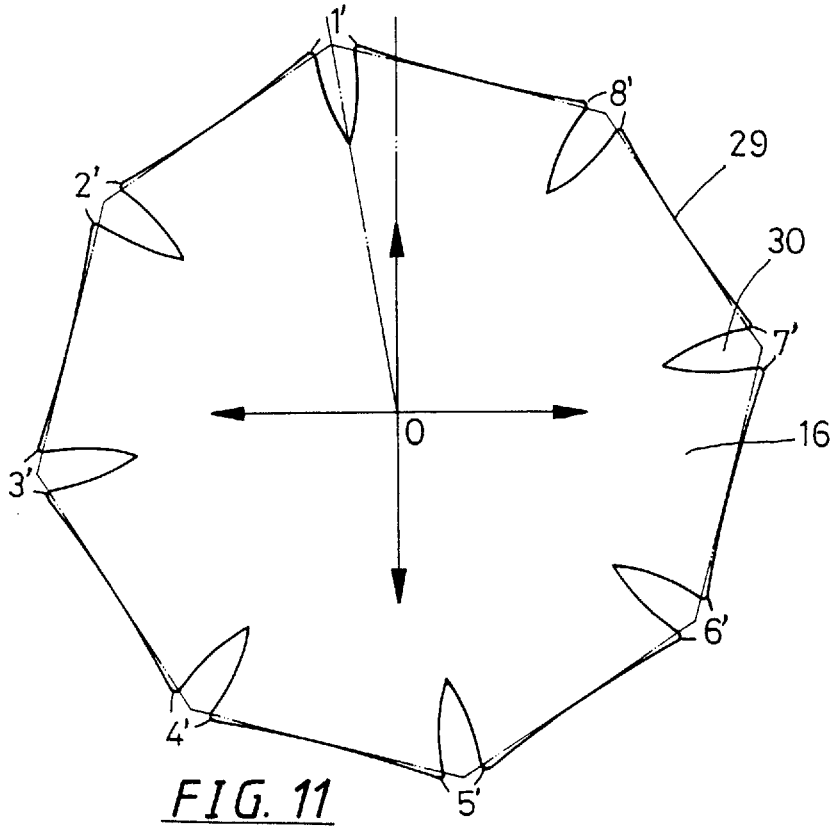
FIG. 11 is a plan view of the present invention, showing the octagonal shape thereof.

As shown in FIG. 10, the umbrella cover 16 is an octagonal cover; the connection points of the edges 29 are indicated with digits from 1 to 8, while the center of the umbrella cover is indicated with "0"; the pulling direction and length of the main ribs are indicated with 01, 02, . . . , 08, regularly. The edges 29 of the octagonal umbrella cover 16 are all in oblique weave mesh. i.e., the stretch direction of the main ribs 17 is not set on the parallel line of the warp or the weft. The edges 29 have been cut (as shown in FIG. 11) and sewed by means of a corrugation-proof method; the connection points between the edges 29 and the ends of the main ribs 17 are mounted with end sheaths 19, or are sewed respectively (as shown in FIG. 8). When the umbrella is opened, a tension force of the main ribs 17 to the umbrella cover 16 will be offset with the stretch of the oblique weave mesh.

According to the present invention, the stretch direction of the main ribs 17 to the umbrella cover is not aligned with the parallel line of the warp or the weft, but is aligned with the oblique weave having a slight stretchability mesh; the direction of the main rib 17 is varied with the weaving structure of the warp and the weft, i.e., having different stretch length on the umbrella cover; the umbrella cover is then cut according to the length stretched, and the edges 29 are processed with a corrugation-proof method. When the umbrella is opened, the central portion 23 of the cover will be stretched with a tension of the main ribs 17 and with the oblique weave mesh so as to buffer the impact upon opening the umbrella; therefore, the central portion 23 would not have corrugation and looseness. When the central portion 23 of the umbrella 11 made of a single-piece umbrella cloth 15 is processed with the method according to the present invention, the edges 29 should also be treated with a corrugation-proof method so as to let the central portion 23 and the edges 29 have no any corrugation and looseness.

Figure 12:
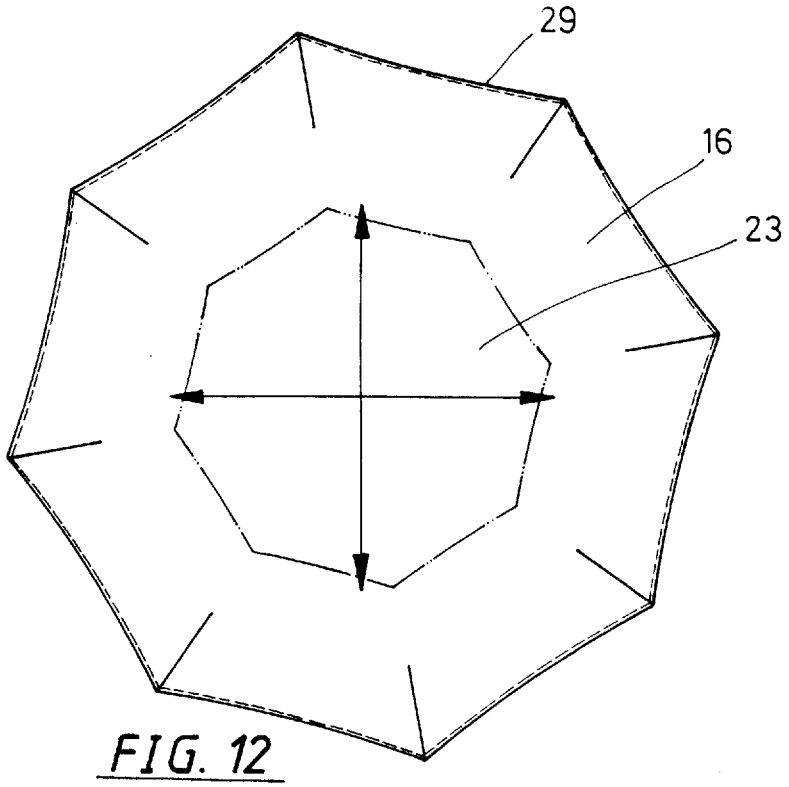
FIG. 12 is a plan view of the present invention, showing the octagonal edge being sewed up.

The first embodiment for treating the edges 29 according to the present invention is shown in FIGS. 8 to 12; FIG. 10 illustrates the edges of the umbrella cloth 15 is not treated with the corrugation-proof method, and 01 and 05 of the umbrella cloth in FIG. 10 have ten degrees apart from the weft, i.e., not setting on the parallel line of the weft, and having a very small stretchability; the very slight stretchability is provided by means of the oblique weave mesh between the warp and the weft within the area of ten degrees of angle. When the main ribs 17 at points 1 and 05 are extended, the very slight stretch in the oblique weave mesh can offset the tension caused by the slight curvature the main ribs 17. The stretch length of the oblique weave mesh at points 1 and 05 is merely used for buffering the stretch of the umbrella cover, and the stretch length is the reference unit to the diameter of an umbrella 11; for example, if an umbrella has a diameter of 120 cm, the length of points 1 and 05 will be 60 cm respectively. As shown in FIG. 11, after the umbrella cover 16 and the edges 29 are processed with a corrugation-proof method, the length of points 1 and 05 is equal to the length of 01' and 05' (i.e., a length from the cover 16 center to the outer angles 01' and 05' of the gap cut 30; the aforesaid length is also the length of the points 1 and 05 upon being sewed together as shown in FIG. 12.

The umbrella cloth in points 02 and 06 has an angle of 55 degrees from the weft, and has an angle of 35 degrees from the warp; the oblique weave mesh has an angle of ten degrees toward the warp. The warp has a very small stretchability; the umbrella cloth in points 02 and 06 has a longer stretch. The umbrella cloth in the points 02 and 06 should be cut shorter so as to balance the tension between the points 02 and 06 and the main rib 17, but it must be smaller than the diameter of the umbrella. The points 02 and 06 are the shortest points of the umbrella cloth; for example, if the length of the points 01 and 05 is 60 cm, the length of the points 02' and 06' will be 58.5 cm only. The points 02 and 06 are areas of the oblique weave mesh which are subject to having a larger stretchability upon the umbrella being opened; therefore, the tension caused by the slight curvature of the main ribs 17 can offset the corrugation and looseness by means of the oblique weave mesh.

Between the points 03 and 07 of the umbrella cloth and the warp, there is an angle of ten degrees; because of not on the parallel line of the warp, the warp having minor stretchability, and they are in the direction of the oblique weave mesh which is stretchable; therefore, the umbrella cloth in that points has larger stretchability than that of points 1 and 05, and they should be cut off a little bit. The length of the points 03 and 07 is just shorter than that of points 01 and 05; for example, if the length of points 1 and 05 is 60 cm, the length of points 03' and 07' will be 59.5 cm.

There is an angle of 55 degrees between the points 04 and 08 and the warp, and an angle of 35 degrees from the weft, i.e., being biased the weft direction that has no stretch; but they have a shorter length than the stretched length points 02 and 06 , and should be cut off a little bit; for example, if the length of points 1 and 05 is 60 cm, the length of points 04' and 08' will be 59.0 cm.

As shown in FIG. 11, the umbrella cover 16 on the radial main ribs 17 has eight equal portions of edges 29, of which every connection point is not fallen on a parallel line of the warp or the weft; the edge has a given stretchability. The length between the umbrella center and the connection points will be cut off in accordance with the stretch length of the oblique weave mesh. The connection point between two edges 29 is furnished with a gap cut 30 having a suitable width and depth; the width and the depth are varied with the shape of an umbrella cover upon being opened. If the umbrella cover has a larger curve, the width and the depth of the gap cut 30 should be increased accordingly, and vice versa.

As shown in FIGS. 8, 11 and 12, the umbrella cover 16 includes eight sectors, of which the edges 29 are all oblique weave meshes. The portion of the main ribs 18 for mounting the umbrella cover are cut at a suitable length; the point for mounting the main rib 17 is furnished with a gap cut 30 having a suitable width and depth. The connecting line in the inner side of the umbrella cover is usually sewed by means of a hemming method; the edge 29 is hemmed with a piping method so as to prevent the edge 29 from corrugation and looseness. The angle part of the edge is mounted with an end sheath 19 or sewing so as to be fastened together with the main rib 17. When the umbrella is opened, the umbrella cover 16 will have no any corrugation and looseness.

Figure 13:
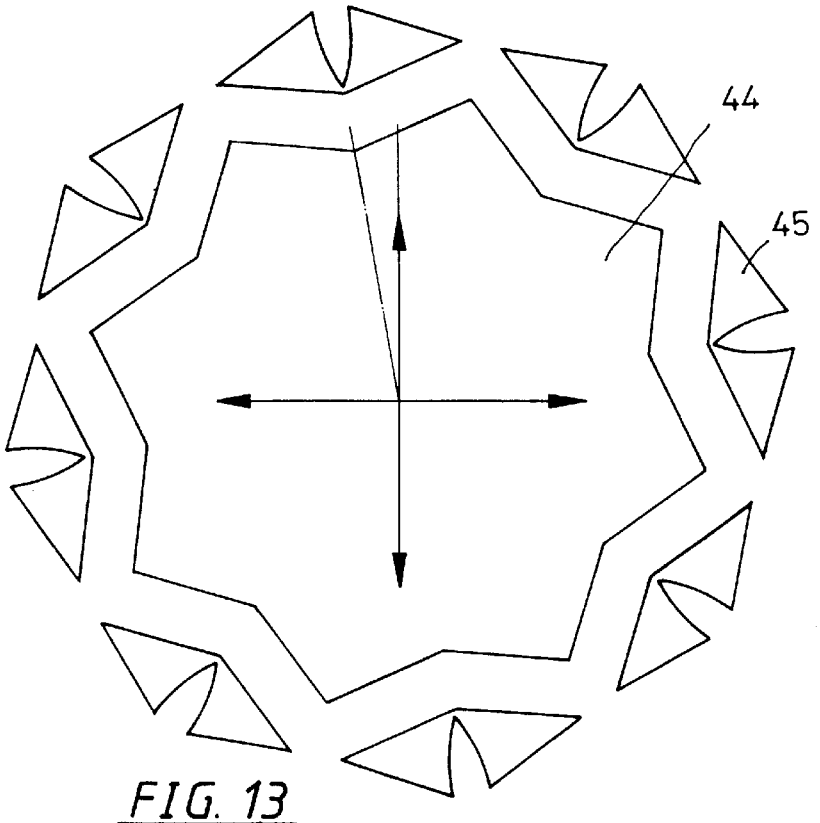
FIG. 13 is a plan view of the embodiment-2 according to the present invention.
Figure 14:
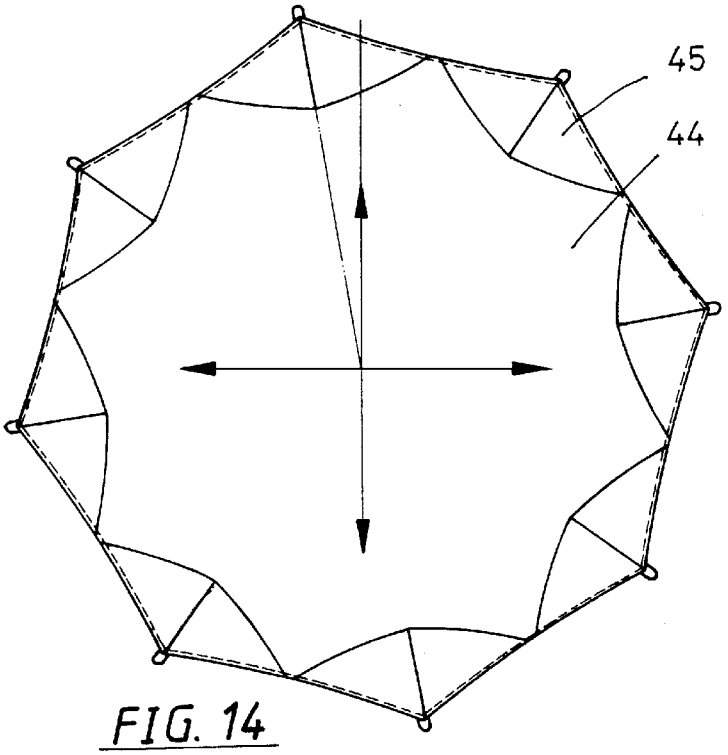
FIG. 14 is a plan view of the present invention, showing the umbrella cover as shown in FIG. 13 being sewed up.
Figure 15:
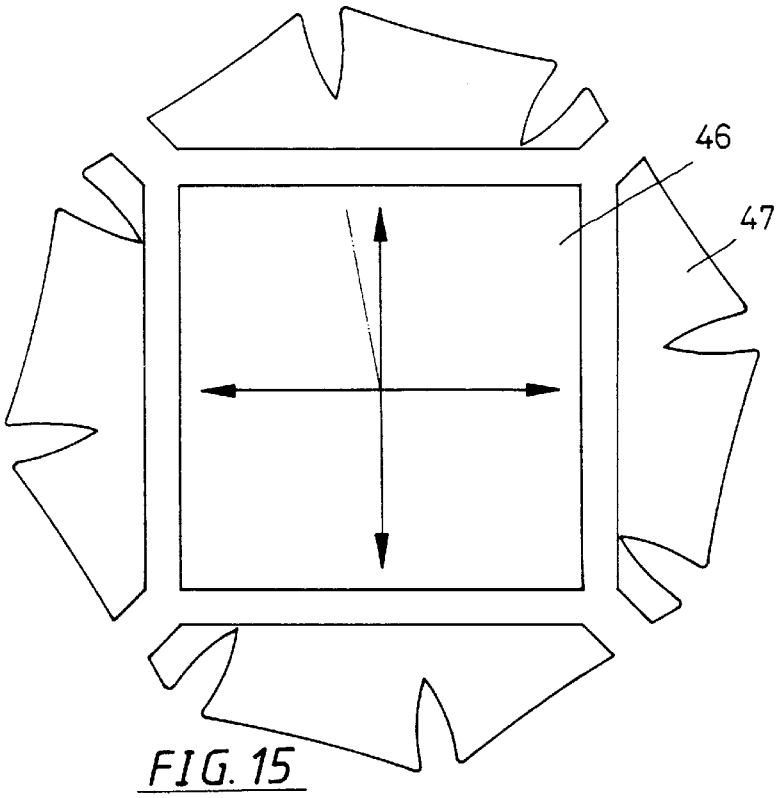
FIG. 15 is a plan view of the present invention, showing a cut-out method-3 of the umbrella cover so as to prevent from corrugation.
Figure 16:
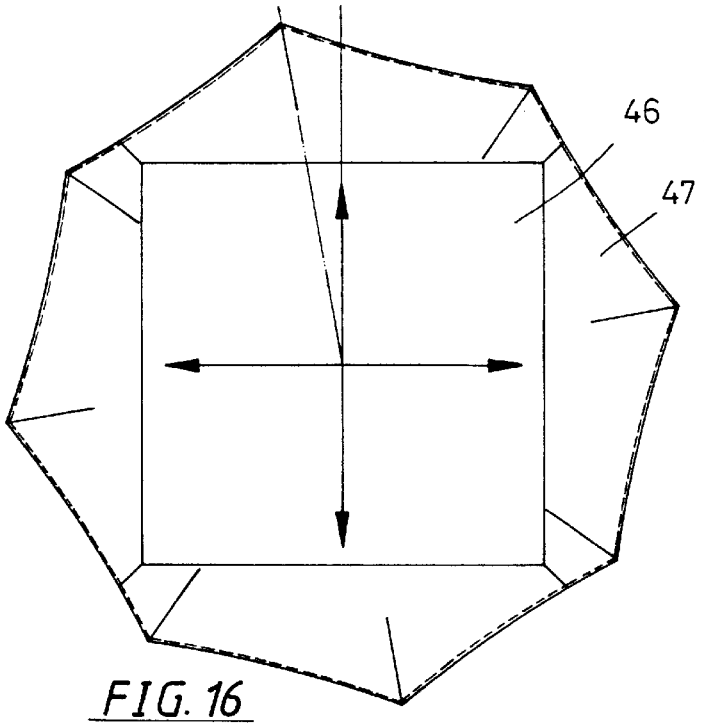
FIG. 16 is a plan view of the present invention, showing the umbrella cover as shown in FIG. 15 being sewed up.

Since the umbrella cover is made of a plain weave cloth, the weft thereof has no stretchability, while warp thereof has very little stretchability. Between the main rib and the warp or the weft, there is an angle of ten degrees so as to have the stretch direction of the umbrella cover not fallen on the parallel line of the warp or the weft; then, the umbrella cover in the main rib direction will be cut and sewed so as to eliminate corrugation and looseness in the central portion and the edge of the umbrella. After the corrugation and looseness problem in the central part of the umbrella cover is overcome, an octagonal umbrella cover 44 can be obtained easily as shown in FIGS. 13 and 14. Along the edge which is stretchable, additional cloth pieces 45 for corrugation-proof are sewed so as to balance the tension between the umbrella center and the edges. FIGS. 15 and 16 illustrate a square-flag cloth 46, being turned at an angle of ten degrees so as to have the main ribs not fallen on the parallel line of the warp and the weft; along the outer edge of the umbrella cloth that is to be pulled, additional cloth pieces 47 are cut and sewed to the oblique weave mesh so as to prevent from corrugation and looseness in the central portion 23 of the umbrella.

According to the aforesaid embodiments described, the features of the method have been disclosed completely, and they are never shown and anticipated by the person skilled in the art; therefore, the present invention is deemed novel and practical.

I claim:

1. A method of eliminating corrugation in a central umbrella cover comprising:

providing an umbrella cloth made of a plain weave mesh cloth;

cutting said umbrella cloth into an octagonal-shaped umbrella cover;

superimposing a set of main ribs on a vertical weft line and a horizontal warp line of said umbrella cover to establish reference lines in a cross configuration;

turning said ribs an angle of ten degrees in the direction of an oblique weave of weft and warp lines;

cutting off an over length portion of said umbrella cloth on said main ribs in accordance with different oblique weave mesh;

reserving a length in said main rib direction of said umbrella cloth so as to provide a length required by a slight curvature upon said umbrella being opened;

cutting the peripheral edges of said umbrella cover at the corners of said octagonal shape inwardly along radially directed lines toward the center of said umbrella cover, so as to prevent corrugation and looseness in said umbrella cover;

wherein a central connection part between said umbrella cover and said main ribs having no corrugation by means of balanced tension in said oblique weave mesh caused by said main ribs upon said umbrella being opened.

2. A method of eliminating corrugation in a central umbrella cover as claimed in claim 1, wherein:

the steps of cutting said umbrella cover into an octagonal-shaped umbrella cover includes cutting the cover from an umbrella cloth of a larger dimension than the dimension of the umbrella cover;

the step of cutting the peripheral edges of said umbrella cover includes cutting the peripheral edges into open gaps of predetermined width and depth in accordance with a possible stretched length of said oblique weave mesh;

sewing said gaps together from an inner side of said umbrella cover by a hemming method;

sewing the edges of said umbrella cover with a piping method, so that said edges and central portion of said umbrella cover have no corrugation and looseness.

3. A method of eliminating corrugation in a central umbrella cover as claimed in claim 1, wherein:

the steps of cutting said umbrella cover into an octagonal-shaped umbrella cover includes cutting the cover from an umbrella cloth of a smaller dimension than the dimension of the umbrella cover;

in accordance with a possible stretched length of said oblique weave mesh, mounting on each of the edges of said umbrella cover with an additional cloth to be cut and sewed for corrugation-proof;

forming said umbrella cover into an octagonal shape without having corrugation in the central portion and edges thereof.

* * * * *